US008866032B2

(12) United States Patent
Giordano et al.

(10) Patent No.: US 8,866,032 B2
(45) Date of Patent: Oct. 21, 2014

(54) ELECTRICAL SWITCH FOR NAUTICAL EQUIPMENT

(75) Inventors: Mario Giordano, Limodo Comasco (IT); Pietro Dario Binda, Bosisio Parini (IT); Andrea Zanetti, Como (IT)

(73) Assignee: Harken Italy, S.p.A., Lurago Marinone (Como) (IT)

( * ) Notice: Subject to any disclaimer, the term of this patent is extended or adjusted under 35 U.S.C. 154(b) by 620 days.

(21) Appl. No.: 13/094,587

(22) Filed: Apr. 26, 2011

(65) Prior Publication Data

US 2011/0259725 A1 Oct. 27, 2011

(30) Foreign Application Priority Data

Apr. 27, 2010 (IT) ..... MI2010A000722

(51) Int. Cl.

| | |
|---|---|
| ***H01H 13/04*** | (2006.01) |
| ***H01H 19/04*** | (2006.01) |
| ***B66D 1/46*** | (2006.01) |
| ***H01H 3/20*** | (2006.01) |
| *H01H 13/16* | (2006.01) |

(52) U.S. Cl.

CPC ..... *H01H 3/20* (2013.01); *H01H 2300/024* (2013.01); *B66D 1/46* (2013.01); *H01H 13/16* (2013.01)

USPC ..... 200/333

(58) Field of Classification Search

USPC ..... 200/333, 334, 43.16, 43.18, 43.19, 200/43.21

See application file for complete search history.

(56) References Cited

U.S. PATENT DOCUMENTS

| | | | | |
|---|---|---|---|---|
| 5,863,028 | A | 1/1999 | Dunsmore | |
| 2002/0020614 | A1 | 2/2002 | Bremner et al. | |
| 2008/0073192 | A1 * | 3/2008 | Lee | 200/333 |

FOREIGN PATENT DOCUMENTS

| | | |
|---|---|---|
| GB | 2445870 | 7/2008 |

OTHER PUBLICATIONS

Italian Search Report; Mar. 14, 2008.

* cited by examiner

*Primary Examiner* — Renee Luebke
*Assistant Examiner* — Lheiren Mae Caroc
(74) *Attorney, Agent, or Firm* — Brian G. Gilpin; Godfrey & Kahn, S.C.

(57) ABSTRACT

The disclosure concerns an electrical switch for nautical equipment. The switch comprises electric actuation means, which in turn comprise at least one control button, able to be connected to an external electric circuit, and a housing of such electric actuation means. Advantageously, the switch also comprises a covering element that is moveable with respect to the housing between a first position, at which the button can be directly activated by the user by just inserting a finger into a suitable recess, and a second position, at which the covering element prevents direct access to the button and is itself moveable by the user in the direction towards the button for its activation. When the covering element is in the second position, the activation of the button can be obtained by pressing the covering element with a foot or with a hand.

18 Claims, 5 Drawing Sheets

SAFE
42
41
C-C

R
81
6
8
C
C

ON
72
42
71
B-B

71
B
B
8

1
D
8
OFF
81
F
32
41
5
3
71
A-A

71
A
A
8

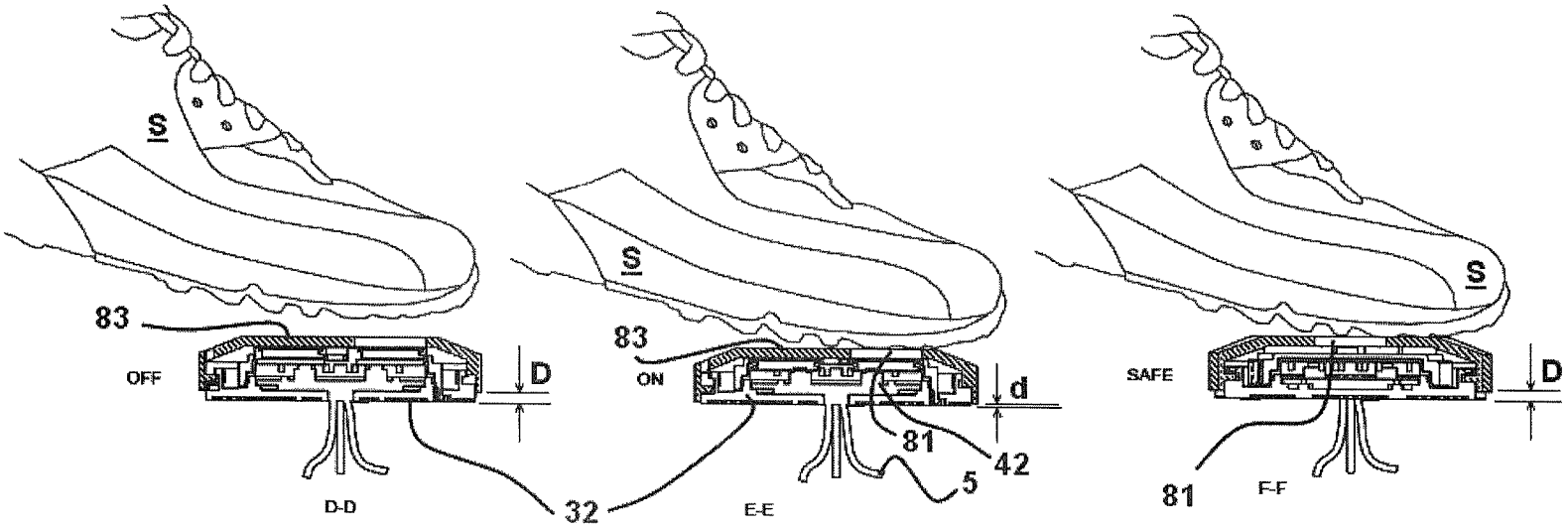
Fig. 7a
Fig. 6a
Fig. 5a
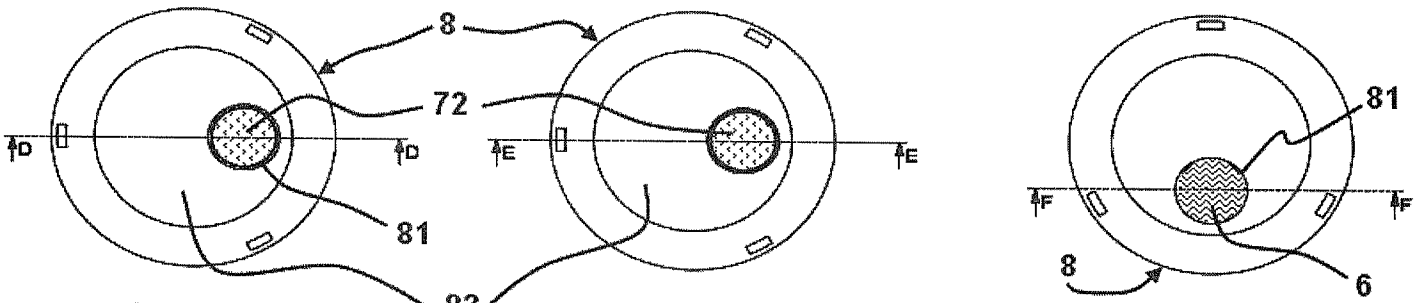
Fig. 7b
Fig. 6b
Fig. 5b

F
82
81
OFF
D-D
72
71
8
D
D

F
42
ON
E-E
41
8
E
E

F
OFF
A-A
42
41
A
A

F
ON
B-B
8
72
71
B
B

F
SAFE
C-C
8
6
C
C

F
SAFE
F-F
6
6
F
F

ELECTRICAL SWITCH FOR NAUTICAL EQUIPMENT

BACKGROUND

The present disclosure refers to an electrical switch for nautical equipment.

Aboard pleasure boats, yachts, ships, etc., electrical actuation nautical equipment is often installed. For example, motorized nautical equipment is available that, for its relative operation, requires an electric power supply and relative switches that can be controlled by the crew. Motorized winches, other systems for adjusting the sail, electrical anchor windlasses, motorized reefing and furling systems, bow thrusters, etc., belong to this category.

U.S. Pat. No. 5,863,028 describes a motorized winch supplied with power by an internal battery of the rechargeable type. The actuation of the winch is controlled by the user by means of a button switch arranged on the upper part of the winch itself, not far from the coupling seat of the handle for the manual actuation of the winch. The switch is of the on/off type, and is generally circular-shaped and has a diameter corresponding to the finger print of just one finger of the hand of the user. In particular the actuation of the winch occurs by only pressing the button and stops as soon as the button itself is released.

Generally, the switches used to control motorized devices installed on board of ships or boats are simply button switches of the type described above, suitable for being activated with a finger.

Such switches typically are provided with a fixed structure in which the circuitry is housed, stably connected to the boat or to the relative controlled device, and a corresponding mobile structure, that can be translated or deformed by the user, comprising the electric contact that closes/opens the electric circuit within which the switch is installed. The switch is sealed in order to avoid water or humidity, which could rust the circuitry, from infiltrating.

The switches conventionally used in the nautical field have some limitations.

A first limitation is given by the fact that the nautical switches conventionally used can be easily activated even by children or non authorized crew, or in any case by people who may not be aware of the risks of activating the relative motorized device, with obvious risks concerning sailing safety and safety of the passengers.

A second limitation is represented by the fact that such switches can exclusively be activated with fingers or if necessary with the palm of a hand. In some circumstances, for example when the switch is arranged at floor level or at the level of the deck of the boat, the relative use is awkward, especially in bad weather conditions when the rolling and pitching of the boat make the passengers on board lose their balance.

A third limitation is given by the fact that the switches conventionally used in the nautical field generally allow a single corresponding electrical device to be activated and turned off. For example, generally it is not possible, with a single switch, to electrically control more than one motorized winch or control the two winch speeds of a winch with many speeds, since the circuitry conventionally installed foresees that a button manages only one rotation speed.

The technical problem forming the basis of the present disclosure is that of providing an electrical switch for applications in the nautical field, i.e., a switch for the actuation of motorized nautical devices or in any case electrically supplied with power, which solves the drawbacks of conventional solutions in a simple and effective manner.

SUMMARY

In a first aspect, the present disclosure thus concerns an electrical switch according to claim 1.

In particular the present disclosure concerns an electrical switch for nautical uses, comprising:

a) electric actuation means able to be connected to an external electric circuit, in which said electric actuation means in turn comprise at least one control button, and b) a housing of said electric actuation means, characterised in that it also comprises c) a covering element that is moveable with respect to said housing between a first position, at which said at least one button can be directly activated by the user, and a second position, at which said covering element prevents direct access to the at least one button and can be moved by the user in the direction towards said at least one button for its activation.

For the purpose of the present disclosure with the term activate we mean to indicate the intervention on a control button through which a change in the operative state of the electric actuation means is obtained. Such a change can be, for example, the opening or the closure of an electric circuit in which the switch is inserted. In these terms the operation of the switch according to the present disclosure can be of the on/off type (instantaneous) for all devices equipped with electric motors with considerable power, or that in any case can cause damage to the crew or to the boat itself if actuated inappropriately. It should be considered that the electrical switch described, can also be connected to less critical systems and that therefore can operate in a continuous manner or intermittently if connected to utilities like on-board lights and sailing lights, the circuitry for turning on and off the endothermic motor, and all the auxiliary utilities present on the boat.

For the sake of simplicity we shall from now on consider the case in which the button is of the pressure type, even though in general the button can be of the electronic, touch, capacitive type, or of another known type.

From a first configuration the activated button is brought by the user into a second configuration. If there is no intervention by the user, the button can automatically be taken back into the first configuration or it can remain in the second configuration until the user intervenes modifying it again.

Advantageously, the switch according to the present disclosure can be activated by the user with his hands when the covering element is in the first position and with a foot when the covering element is in the second position.

This characteristic is particularly advantageous especially on sail boats, which are famous for undergoing rolling and pitching. The switch according to the present disclosure can be arranged on the boat in a lowered position, easily accessible to the crew with their feet, for example at the deck or near to the nautical device to be controlled, even if separate from the latter. While sailing, a member of the crew can move the covering element with respect to the housing of the switch according to whether he desires to activate the control button with his hands or with a foot, which is a circumstance that can easily occur when the boat is heeled and the deck is inclined with respect to the horizontal plane. The activation of the control button with a foot occurs by interposition of the covering element, which in response to pressure exerted with a foot by the user moves towards the button until it is brought into abutment against it and this is activated.

Preferably, in the relative second position, the covering element is able to translate with respect to the housing. The translation is foreseen in the direction towards the button. In its lowered position the covering element presses the button, activating it. In its raised position the covering element does not exert pressure on the button, which remains inactive.

According to an embodiment of the switch according to the present disclosure, the covering element is moveable with respect to the housing into a third position, at which the activation of the button by the user is prevented, both manually and with a foot through the same covering element. In other words the covering element is configured, in its third position, like a safety that prevents the accidental activation of the button.

In a further embodiment of the switch, the electric actuation means comprise a first button and at least one second button. Moreover, the switch comprises the following characteristics:

e) in the first position of the covering element the buttons can both be directly activated by the user, and f) in the second position of the covering element just one of the buttons can be activated by the user, exclusively by moving the same covering element against the button to be activated, and access to the other button is prevented and g) in the third position of the covering element direct access to, and the activation of, all of the buttons is prevented regardless of the action of the user on the covering element.

The characteristic g) prevents the accidental actuation by children or inexperienced crew members, this promoting safety.

Advantageously, the switch can comprise many control buttons, for example two, three or more. Each button can be intended to actuate a single device, for example an anchor windlass or a jib furler. Alternatively, two buttons can control a single device, for example they can respectively control the clockwise or anti-clockwise direction of a motorized mainsail furler so as to unwind or wind the spanker, or they can control the rotation, respectively clockwise/anti-clockwise, of an anchor windlass, etc.

Preferably, the movement that brings the covering element in any one of said first, second and third position is a rotary movement with respect to the housing.

More preferably, the housing and the relative covering element are substantially circular in shape and are arranged coaxially, i.e. they develop around one same axis. The covering element rotates around the axis shared with the housing.

Preferably, the housing comprises a base able to be constrained to an external structure, permanently or removably, and the covering element is mounted on the housing in an opposite position with respect to the base.

Preferably, the covering element is provided with at least one through hole, through which the user can insert at least one finger, and comprises at least one surface suitable for abutting against a button. In the first position of the covering element the through hole is aligned with the corresponding button, which can be pressed manually by the user through the hole itself, and in the second position of the covering element the button is offset with respect to the corresponding through hole, remaining inaccessible for the user's hands, and is aligned with the abutment surface of the covering element. The activation of the button can thus be obtained by the user by applying pressure on the covering element that is sufficient to cause it to move towards the button itself, until the abutment surface is brought into contact with the button and presses the latter.

In one embodiment of the switch also in the relative first position the covering element is moveable by the user in the direction towards the corresponding button, which inserts through the through hole of the covering element without interacting with it and therefore without being activated by the abutment surface.

In an alternative embodiment of the switch in the relative first position the covering element cannot be moved by the user in the direction towards the corresponding button.

Preferably, the covering element is provided with a first through hole and at least one second through hole through which at least one of the user's fingers can be inserted. In the first position of the covering element the first through hole and a second through hole are respectively aligned with the first button and the second button, each of which can be pressed by the user through the corresponding hole of the covering element. In the second position of the covering element just one among the first through hole and the second through hole is aligned with the relative button and the other among the first button and the at least second button is offset with respect to the through holes, remaining inaccessible for the user's hands, and is aligned with an abutment surface of the covering element suitable for the abutment against a button to activate it.

Preferably, the covering element activates just the button aligned with the abutment surface when it is in the aforementioned second position and is pushed by the user against the button itself, and does not activate the other button (aligned with a through hole) that, in the movement towards the covering element, goes through the corresponding through hole without interacting with it.

Preferably, the housing in turn comprises a base able to be constrained to external structures in a permanent or removable manner, a closing cap, coupled at the top to the base and at least partially inserted into the covering element, and a gasket. The electric actuation means may be housed between the base and the gasket and the gasket is at least partially compressed between the closing cap and the base in order to avoid water or humidity from infiltrating towards the electric actuation means.

More preferably, the closing cap comprises a number of through holes corresponding to the number of buttons of the electric actuation means. The through holes of the closing cap are always aligned with the corresponding buttons (the cap is fixed to the base in a stationary manner). The gasket completely covers the electric actuation means and the relative buttons and protects them against the entry of water through the through holes of the closing cap.

Preferably, the gasket is made from a resilient material, for example from silicone, and extends at least partially through the through holes of the closing cap, towards the covering element, and elastically counteracts the movements towards the covering element with respect to the housing. In this circumstance the gasket operates as a contrasting element that brings the covering element back into a raised position after being pressed by the user against the housing and then released.

Preferably, the base is perforated at the bottom so as to allow the passage of external electric cables for connecting the electric actuation means to an electric circuit of the boat.

Alternatively to or in addition to the electric connection with the cables passing through the base of the housing, the switch comprises an internal electric power supply device, and remote transmission means of the electrical signals given by the user by means of the buttons. The remote transmission means and the electric actuation means are supplied with power by the power supply device, for example a battery or a photovoltaic cell on the cap. The remote transmission means may comprise, for example, a wi-fi interface, a radio interface, or bluetooth, etc.

Preferably, the covering element is shaped so as to allow, at least in the relative second position, the activation of at least one button by the user by means of a foot even not covered with a shoe.

The switch according to the present disclosure is particularly suitable for allowing an electric circuit aboard boats to open and close.

In particular, the switch has an application for the activation and/or turning off of at least one device selected from a winch, an anchor windlass, a mainsail furler, a jib furler, a bilge pump, a bimini, one or more davits, etc.

BRIEF DESCRIPTION OF THE DRAWINGS

Further characteristics and advantages of the present disclosure shall become clearer from the following detailed description of some of its preferred embodiments, given with reference to the attached drawings. In such drawings.

FIGS. 5*a* and 5*b* are respectively a section view and a view from the top of the switch shown in FIG. 1, assembled, in a second configuration;

FIGS. 6*a* and 6*b* are respectively a section view and a view from the top of the switch shown in FIG. 1, assembled, in a third configuration during actuation;

FIGS. 7*a* and 7*b* are respectively a section view and a view from the top of the switch shown in FIG. 1, assembled, in a third configuration;

DETAILED DESCRIPTION

Reference will now be made in detail to exemplary aspects of the present disclosure which are illustrated in the accompanying drawings. Wherever possible, the same reference numbers will be used throughout the drawings to refer to the same or like parts.

Figure 1:
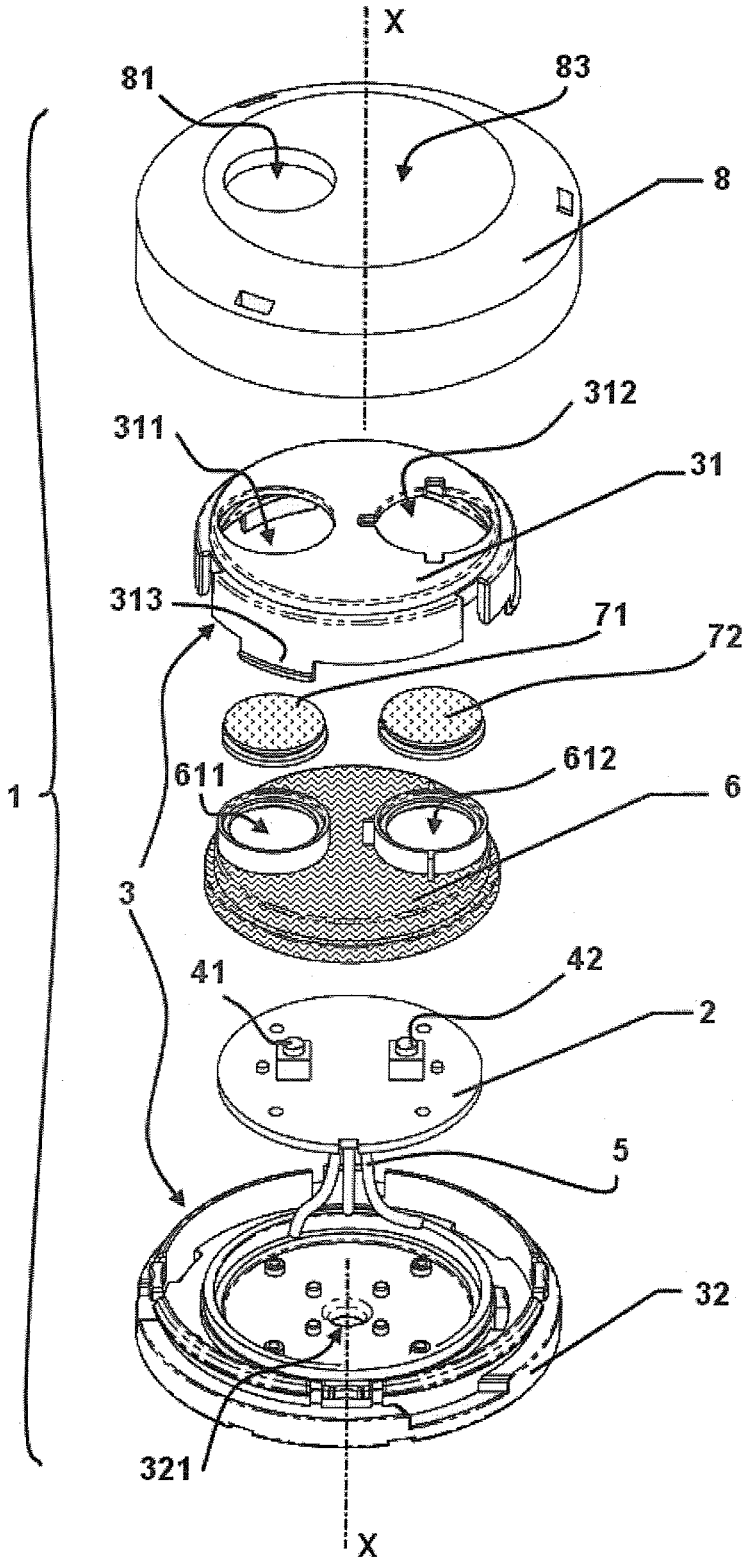
FIG. 1 is an exploded view of a first embodiment of an electrical switch according to the present disclosure.

FIG. 1 shows an exploded view of a first embodiment of a switch 1 according to the present disclosure, conceived for applications in the nautical field, and in particular for the activation of electrical apparatuses aboard boats.

The switch 1 comprises electric actuation means 2, able to be connected to an external electric circuit, and a relative housing 3.

The electric actuation means 2 are made in the form of an electric circuit, for example comprising electrical wires and/or relays and/or a printed circuit with the relative components mounted, etc. In the example shown in the figures, the electric actuation means 2 are formed as a printed circuit, the circuit diagram or possible other components of which are not shown for the sake of simplicity.

The electric actuation means 2 in turn comprise at least one control button, for example of the pressure type able to be actuated by the user by manually exerting pressure on the button in a vertical direction.

In the example shown in FIG. 1 there are two control buttons 41 and 42 directly applied onto the printed circuit 2, facing upwards. Electric wires 5 are connected to the printed circuit 2 for connecting to an external circuit to which the switch 1 is associated. The wires 5 come out from the housing 3 through a corresponding hole.

The housing 3 shown in FIG. 1 is made up of a base 32, able to be constrained to external structures in a permanent or removable manner, and a closing cap 31, coupled at its top to the base 32. Preferably, the base 32 and the closing cap 31 are made with an injection moulding technique or through thermoforming of a plastic material, for example they are thermoformed or moulded in polycarbonate or ABS plastic, or in Teflon, Nylon etc., even filled with microfibres, microspheres or other additives that are suitable for modifying the native characteristics of the polymer. The base 32 comprises a through hole 321 through which wires 5 extend towards the electric circuit associated with the switch 1.

The coupling between the base 32 and the closing cap 31 is preferably obtained through snap-fitting, for example by providing the closing cap with elastic tabs 313 which are engaged in corresponding seats of the base 32. Alternatively, the coupling between the two elements is obtained through screws, glues or other sealing substances, for example silicone, etc.

The switch 1 shown in FIG. 1 also comprises a gasket 6 made from an elastic material that is water resistant, for example silicone. The gasket 6 is preferably shaped so as to adapt in a matching manner to the internal shape of the closing cap and to the shape of the upper surface of the electric actuation means 2. The gasket 6 is shaped like a membrane that protects the buttons 41 and 42, while still allowing them to be activated by the user. In particular, the gasket 6 can be elastically deformed by the user to reach a button 41 or 42 and returns to the initial configuration, shown in FIG. 1, when the external force given by the user himself stops. In this sense the gasket 6 is configured like a resilient element.

The gasket 6 remains compressed between the base 32 and the closing cap 31 of the housing 3 so as to prevent water and humidity from entering into the area of the electric actuation means 2. Preferably, the base 32 and the closing cap 31 are coupled at the relative perimeter, and again at the perimeter they exert pressure on the gasket 6. Between the base 32 and the shaped gasket 6 there is a cavity in which the electric actuation means 2 are housed.

In particular, in the switch 1, assembled and ready to use, the electric actuation means 2 remain insulated and protected from water inside the housing 3, in the cavity formed between the base 32 and the gasket 6.

The closing cap 31 is provided with two through holes 311 and 312 formed through the relative surface. The holes 311 and 312 both have a diameter such as to allow the insertion of at least one of the user's fingers. The holes 311 or 312 are each aligned with a button 41 or 42 and the user can intervene to actuate one of the buttons 41 or 42 by inserting a finger through the hole 311 or 312 and deforming the gasket 6 until a pressure on the corresponding button 41 or 42 has been exerted. When the user stops exerting pressure, the gasket 6 returns to its initial undeformed configuration shown in FIG. 1, disengaging the buttons 41 and 42.

The gasket 6 prevents water and humidity from being able to infiltrate into the housing 3 through the holes 311 and 312 of the closing cap 31.

Preferably, but not necessarily, the switch comprises two preferably circular elements 71, 72, in practice two discs, made from a rigid material, each of which is housed in a corresponding seat 611, 612 obtained in the shaped gasket 6. The discs 71 and 72 can have different colour and/or shape and have the function of helping the user to tell which of the buttons 41 and 42 he is about to actuate, in addition to the function to evenly distribute the pressure exerted by the user himself on the gasket 6 during the activation of a button 41 or 42. In an alternative embodiment the gasket 6 is flat at the top and there are no discs 71 and 72 and relative seats.

The switch 1 also comprises a covering element 8 that is moveable with respect to the housing 3. The base 32 and the closing cap 31 are fixedly coupled; the base 32 is able to be constrained to an external structure, for example the deck of the boat, and in this circumstance the housing 3 remains stationary and the covering element 8 is moveable by the user with respect to the base 32 and to the closing cap 31 fixedly attached to it.

In particular, the covering element 8 is moveable with respect to the housing 3 between a first position, at which the button 41 can be directly activated by the user, by exerting vertical pressure on the disc 71 with a finger inserted through the hole 81, and a second position, at which the covering element 8 prevents fingers from gaining access to the button 41 and can be moved by the user in the direction towards the button 41 for its activation through the abutment surface 83.

Preferably, the covering element 8 is moveable with respect to the housing 3 into a third position, called safety position, at which the activation of the button 41 by the user is prevented both manually and through the covering element 8.

In general, the movement of the covering element 8 with respect to the housing 3 can foresee rotations and/or translations, or even movements of partial inclination of the covering element 8.

Preferably, in the second position mentioned above, the covering element 8 is able to translate with respect to the housing 3 in the direction towards the button 41. With reference to FIG. 1, the translation movement is foreseen along the axis X-X common to the housing 3 and to the covering element 8.

The operation of the switch 1 is obvious by looking at FIGS. 2*a*-4*b* and 5*a*-7*b*, which shall now be taken into consideration.

Figures 2A, 2B, 3A, 3B, 4A, 4B:
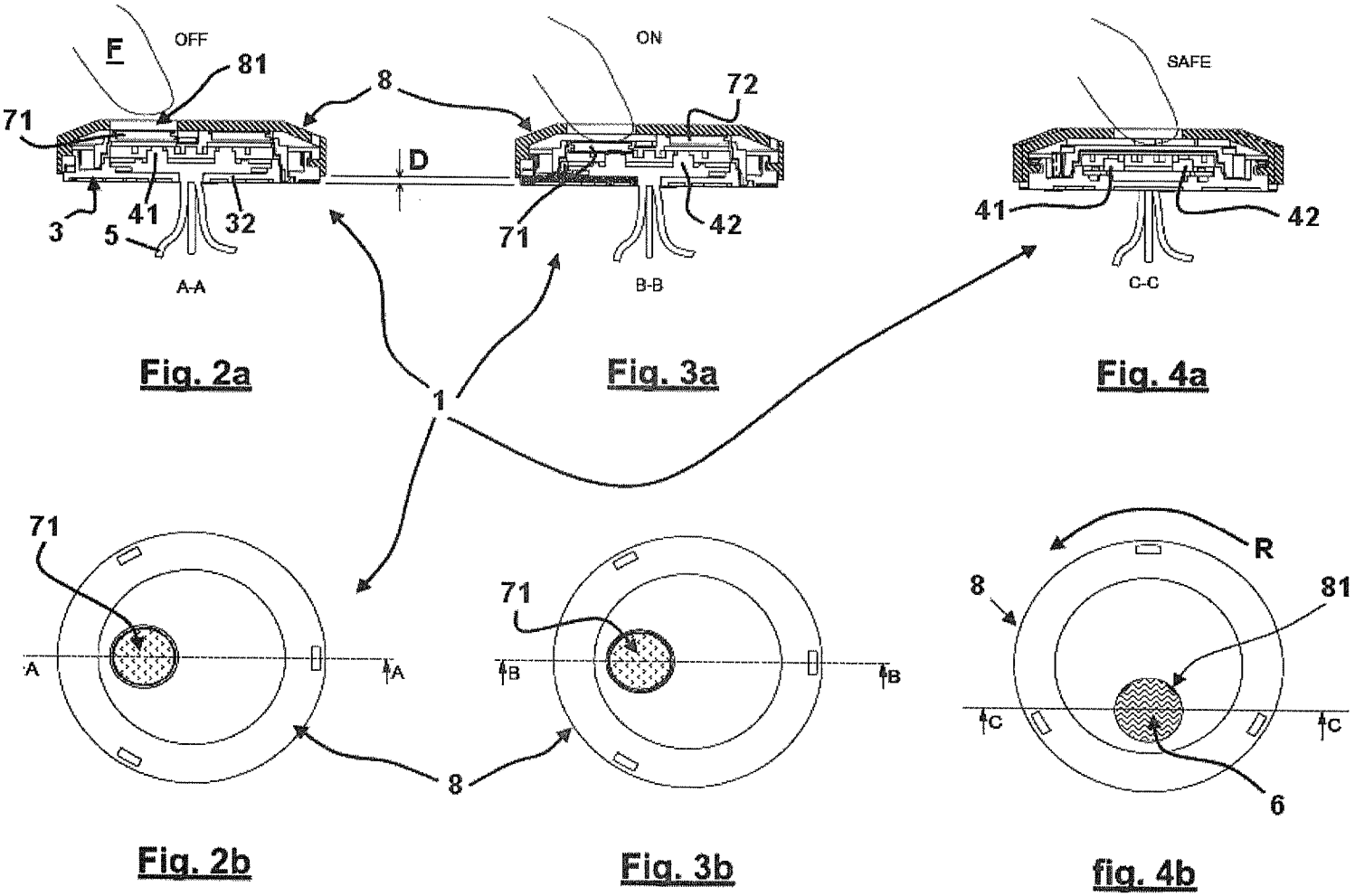
FIGS. 2*a* and 2*b* are respectively a section view and a view from the top of the switch shown in FIG. 1, assembled, in a first configuration.
FIGS. 3*a* and 3*b* are respectively a section view and a view from the top of the switch shown in FIG. 1, assembled, in a first configuration during actuation.
FIGS. 4*a* and 4*b* are respectively a section view and a view from the top of the switch shown in FIG. 1, assembled, in a third configuration.

FIG. 2*b* shows a plan view from the top of the switch 1 in a first configuration and FIG. 2*a* is a cross section view along the plane A-A of FIG. 2*b*. The covering element 8 is in its first position with respect to the housing 3, i.e. with the through hole 81 aligned with the first button 41, in practice aligned with the disc 71 positioned above and in line with the button 41. The button 41 is not actuated.

FIG. 3*b* shows a plan view from the top of the switch 1 again in the first configuration and FIG. 3*a* is a cross-section view along the plane B-B of FIG. 3*b*. The user is actuating the switch 1 exerting pressure on the gasket 6 and on the button 41 with his finger F. In particular, the finger F is inserted through the through hole 81 and presses vertically on the disc 71. The pressure is sufficient to deform the silicone gasket 6 which in turn exerts an actuation pressure on the button 41. The activation of the button 41 can correspond, for example, to the activation of a jib furler in the direction of winding of the relative sail, or can correspond to the rotation of a winch in a clockwise or anti-clockwise direction, etc.

By releasing the button 41, it returns into its initial conditions, for example non active. The gasket 6 returns to its initial undeformed configuration, pulling along with it the disc 71 inserted into the corresponding seat 611. In this way the opening and the closure of the circuit connected to the button 41 is obtained.

From the first position shown in FIGS. 2*a*, 2*b*, 3*a*, 3*b*, the covering element 8 is manually moveable into the second and third position with respect to the housing 3 depending on the requirement.

FIG. 4*b* shows a plan view from the top of the switch 1 in a third configuration and the FIG. 4*a* is a cross section view along the plane C-C of FIG. 4*b*. In this third configuration the covering element 8 has been put in the third position, the safety position, following a rotation of about 90° around the axis X-X shared with the housing 3, according to the anti-clockwise direction indicated by the arrow R in FIG. 4*b*. Alternatively, the rotation can be set in the clockwise direction. In this third position the through hole 81 is not aligned with any button 41, 42 of the electric actuation means 2; the user has access to the gasket 6, but it is not able to activate a button 41 or 42. This configuration is particularly advantageous to prevent the accidental or undesired actuation of the switch 1, and therefore of the equipment connected to it, by the crew. It is very useful if there are children or inexperienced people on board.

Preferably, both in the first and in the third position, the covering element 8 cannot be moved closer towards one of the buttons 41 or 42. In other words the distance D indicated in FIGS. 2*a* and 3*a* remains unvaried even in the case in which the user exerts a vertical pressure downwards, i.e. towards the base 32 of the housing 3 on the covering element 8.

Alternatively, in the first position the covering element 8 can be slidable with respect to the housing 3.

FIG. 5*b* shows a plan view from the top of the switch 1 in a second configuration, not in use, and the FIG. 5*a* is a cross section view along the plane D-D of FIG. 5*b*. The covering element 8 is in a second position, which respect to the first position described above is rotated by 180° around the axis X-X shown in FIG. 1.

In the second position, the covering element 8 is able to translate with respect to the housing 3 in the direction that brings the abutment surface 83 to engage one of the buttons 41 or 42.

FIG. 6*b* shows a plan view from the top of the switch 1 in the second configuration, but in use, and FIG. 6*a* is a cross-section view along the plane E-E of FIG. 6*b*.

A comparison between FIGS. 5*a* and 6*a* helps to understand how the switch 1 operates in this second configuration.

The movement of the covering element 8 towards the housing 3 is obtained by pressing the same covering element 8 with a foot S. In the example shown in the figures a shoe is fitted on the foot S, but this condition is not obligatory, since it is sufficient to suitably model the covering element 8 so that it can also be activated barefoot.

The coupling between the covering element 8 and the housing 3, and in particular between the covering element 8 and the base 32 of the housing 3 is obtained with fittings which allow the rotation of the covering element 8, preferably in a single direction, and the vertical translation along the axis X-X, preferably only in the second position of the element 8.

When the user exerts pressure with the foot S, the element 8 in its second position is lowered towards the housing 3 and the distance between the two elements is reduced, going from a maximum value D to a minimum value d, as shown in FIG. 6*a*. In its lowered position, shown in FIG. 6*a*, the covering element 8 activates the button 41, pressing the disc 71 and the gasket 6 with its abutment surface 83. In the same circumstance, as shown in FIGS. 6*a* and 6*b*, the second button 42 is not activated since the disc 72 and the gasket 6 extend at least partially in the hole 81 of the covering element 8, which is aligned with the button 42. The button 42 can be manually activated with a finger, if necessary, for example to activate a second winch in addition to a first winch controlled by the button 41.

When the pressure exerted by the user stops, the element 8 returns to its initial raised position. The necessary thrust is provided by the gasket 6 which undergoes an elastic return. In its raised position, or initial position, shown in FIG. 5*a*, the covering element 8 does not press any button 41 or 42, which remain inactive.

The activation with a foot is particularly useful in bad sea conditions, or even during a regatta or competition, when the dynamic behaviour of the boat requires hands to be engaged or simply even to optimize the actuation manoeuvre by the user himself.

FIG. 7*b* shows a plan view from the top of the switch 1 in the third configuration and FIG. 7*a* is a cross-section view along the plane F-F of FIG. 7*b*. In this third configuration the covering element 8 has been rotated into the third position, the safety position, and it cannot vertically translate with respect to the housing 3 (with respect to which it keeps its maximum distance D), making it actually impossible to activate any one of the buttons 41 or 42, both manually with the finger F and with the foot S.

Figure 8:
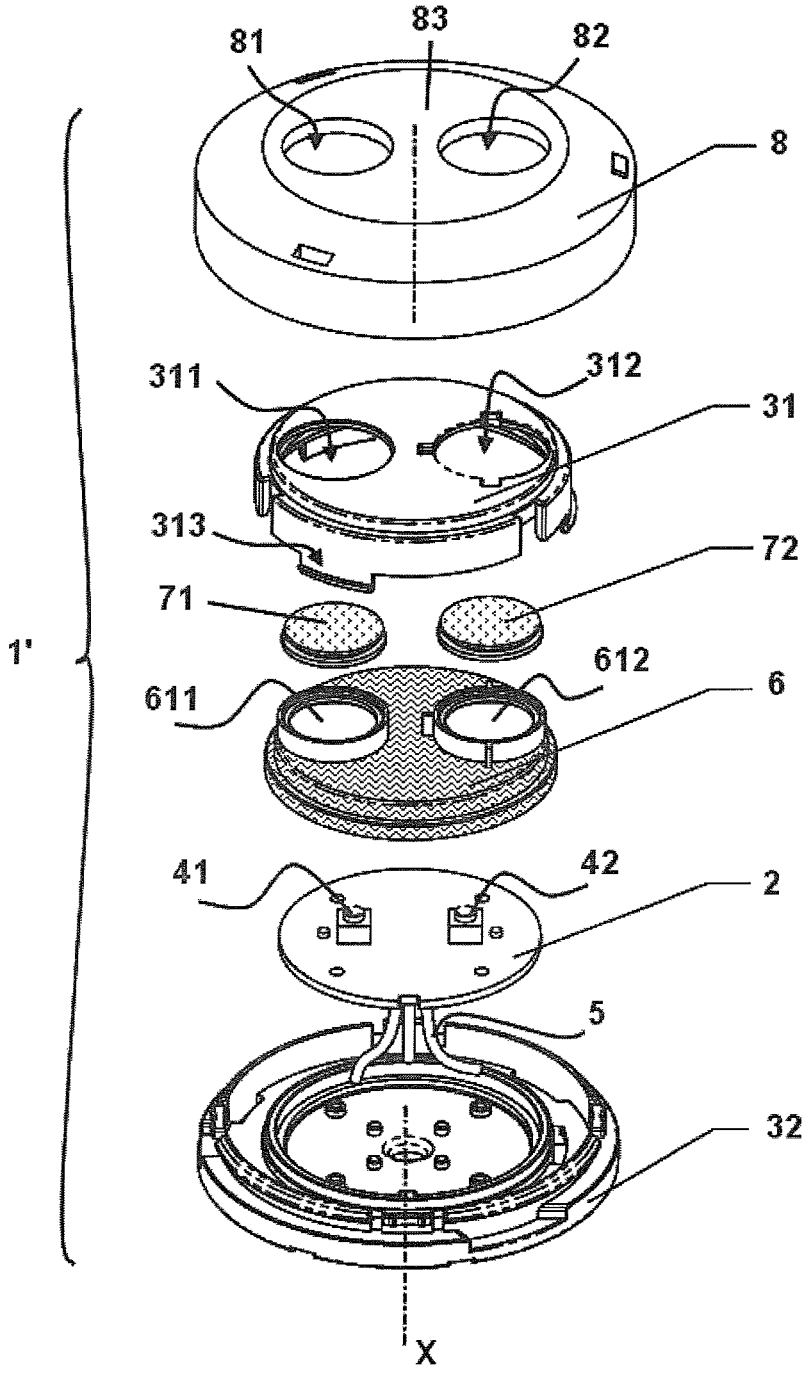
FIG. 8 is an exploded view of a second embodiment of an electrical switch according to the present disclosure.

FIG. 8 shows an exploded view of a second embodiment of a switch 1' according to the present disclosure, which is different from the first embodiment for its covering element 8, which has two through holes 81, 82 instead of only one. The through holes 81 and 82 are diametrically opposite with respect to the axis X-X, even if this arrangement can be different according to the intended use of the switch. The other components of the switch 1' are substantially identical or equivalent to the components of the switch 1 and have been identified with the same reference numerals.

FIGS. 8 to 13*b* explain the operation of the switch 1'.

Figures 8A, 8B, 9A, 9B, 10A, 10B, 11A, 11B, 12A, 12B, 13A, 13B:
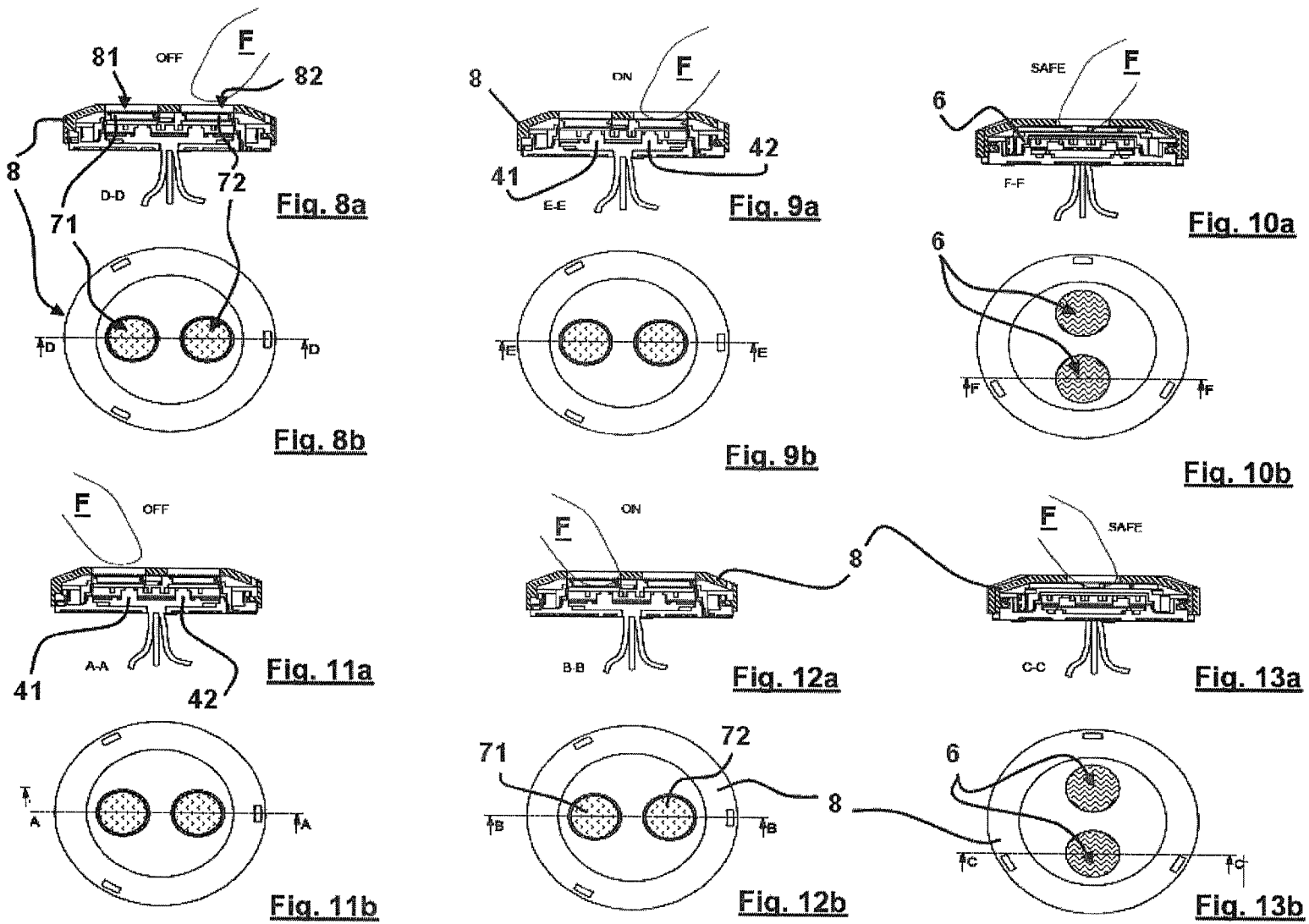
FIGS. 8*a* and 8*b* are respectively a section view and a view from the top of the switch shown in FIG. 8, assembled, in a first configuration.
FIGS. 9*a* and 9*b* are respectively a section view and a view from the top of the switch shown in FIG. 8, assembled, in a first configuration during actuation.
FIGS. 10*a* and 10*b* are respectively a section view and a view from the top of the switch shown in FIG. 8, assembled, in a third configuration.
FIGS. 11*a* and 11*b* are respectively a section view and a view from the top of the switch shown in FIG. 8, assembled, in a first configuration.
FIGS. 12*a* and 12*b* are respectively a section view and a view from the top of the switch shown in FIG. 8, assembled, in a first configuration during actuation.
FIGS. 13*a* and 13*b* are respectively a section view and a view from the top of the switch shown in FIG. 8, assembled, in a third configuration.

In particular, FIGS. 8*b* and 9*b* show a plan view from the top of the switch 1' in a first configuration, respectively not in use and in use, and FIGS. 8*a* and 9*a* are cross-section views respectively along the plane D-D of FIG. 8*b* and along the plane E-E of FIG. 9*b*. The covering element 8 is in its first position. The first through hole 81 and the second through hole 82 are both respectively aligned with the first button 41, in practice with the disc 71, and with the second button 42, in practice with the disc 72. The switch 1' shown in FIGS. 8*a* and 8*b* is inactive; in FIGS. 9*a* and 9*b* the user actuates the second button 42 by exerting pressure with the finger F on the disc 72 through the hole 82 of the covering element, and the first button 41 remains inactive.

FIGS. 11*b* and 12*b* show a plan view from the top of the switch 1' again in the first configuration, respectively not in use and in use, and FIGS. 11*a* and 12*a* are cross section views respectively along the plane A-A of FIG. 11*b* and along the plane B-B of FIG. 12*b*. The covering element 8 is in its first position. The first through hole 81 and the second through hole 82 are both respectively aligned with the first button 41, in practice with the disc 71, and with the second button 42, in practice with the disc 72. The switch 1' shown in FIGS. 11*a* and 11*b* is inactive; in FIGS. 12*a* and 12*b* the user actuates the first button 41 by exerting pressure with the finger F on the disc 71 through the hole 81 of the covering element 8, and the second button 42 remains inactive.

In one alternative embodiment, the holes 81 and 82 of the covering element 8 are not aligned along a diameter of the element 8 itself, but are arranged, for example, with an angle of 90° with respect to the centre of the covering element 8, where the axis X-X passes. In this embodiment just one of the buttons 41 or 42 can be accessed by the user through the relative disc 71, 72 when the covering element 8 is in the first position. In this alternative embodiment, from the first position the covering element 8 can be manually brought into a second position at which just one among the first through hole 81 and the second through hole 82 is aligned with the relative button 41, 42 and the other among the first button 41 and the second button 42 is offset with respect to both the through holes 81, 82, remaining inaccessible for the user's hands. In this circumstance the second button 42 is aligned with the abutment surface 83 of the covering element 8, which can translate vertically so as to make it possible to actuate the button not aligned with the hole. This configuration of the switch 1' is not shown in the attached figures.

FIGS. 10*b* and 13*b* show a plan view from the top of the switch 1' in the third, safety, configuration and FIGS. 10*a* and 13*a* are cross-section views respectively along the plane F-F of FIG. 10*b* and along the plane C-C of FIG. 13*b*. The covering element 8 shown in FIGS. 13*a* and 13*b* is rotated by 180° around the axis X-X with respect to the same element 8 shown in FIGS. 10*a* and 10*b*. The two positions are in fact equivalent to the third position of the covering element 8, called safety position (equivalent to the third position of the element 8 in the first embodiment of the switch 1). In such a position the activation of any one of the buttons 41 or 42 is prevented. The user has access to the gasket 6 through the holes 81 and 82, but is not able to press any button 41 or 42.

In a third embodiment of the switch according to the present disclosure, not shown in the attached figures, the base 32 can be manually separated from the structure of the boat to which it is associated and the controls given with the activation of the buttons 41, 42 are transmitted remotely, i.e. wirelessly, to a receiving control unit arranged on the boat. In this way the switch can be used as a radio control to activate the nautical equipment from a distance. In this embodiment the switch comprises an electric power supply device inside the housing 3, for example a rechargeable battery or a photovoltaic cell installed on the covering element 8, and means for the remote transmission of the electrical signals given by the user by means of the buttons 41, 42. The wires 5 can also not be present, or, if foreseen, are of the extensible type.

The switch 1, 1' makes it possible to activate different nautical equipment such as, for example, winches, spanker furlers, jib furlers, anchor winches, etc., with hands or feet easily and in a completely safe manner, irrespective of the sailing conditions. Moreover, it makes it possible to keep the apparatuses out of reach from accidental activation.

While the disclosure has been described with reference to preferred embodiments, it is to be understood that the disclosure is not intended to be limited to the specific embodiments set forth above. Thus, it is recognized that those skilled in the art will appreciate that certain substitutions, alterations, modifications, and omissions may be made without departing from the spirit or intent of the disclosure. Accordingly, the foregoing description is meant to be exemplary only, the disclosure is to be taken as including all reasonable equivalents to the subject matter of the disclosure, and should not limit the scope of the disclosure set forth in the following claims.

The invention claimed is:

1. An electrical switch for nautical uses, comprising:

electric actuation means able to be connected to an external electric circuit, wherein said electric actuation means in turn comprise at least one control button, and a housing for said electric actuation means, characterised in that it also comprises:

a covering element moveable with respect to said housing between a first position, at which said at least one button can be directly activated by a user, and a second position, at which said covering element prevents direct access to the at least one button and can be moved by the user in the direction towards said at least one button for its activation, wherein said covering element is able to rotate with respect to said housing between said first position and said second position, and wherein said housing and said covering element are arranged coaxially such that said covering element rotates around an axis shared with said housing.

2. The switch according to claim 1, wherein in said second position the covering element is able to translate with respect to the housing in the direction towards said at least one button and wherein in its lowered position the covering element activates said at least one button by pressing it, and in its raised position the covering element does not press said at least one button, which remains inactive.

3. The switch according to claim 1, wherein said housing and said covering element are substantially circular in shape.

4. The switch according to claim 1, wherein said housing comprises a base able to be constrained to an external structure, permanently or removably, and said covering element is mounted on said housing in an opposite position with respect to said base.

5. The switch according to claim 1, wherein said covering element is provided with at least one through hole, through which at least one of the user's fingers can be inserted, and at least one surface suitable for abutting against said at least one button, and wherein in said first position of the covering element the at least one through hole is aligned with said at least one button, which can be pressed manually by the user through said hole, and in said second position of the covering element said at least one button is offset with respect to said through hole, remaining inaccessible for the user's hands, and is aligned with said at least one abutment surface of the covering element.

6. The switch according to claim 5, wherein the covering element activates said at least one button by means of said abutment surface when it is in said second position and is pushed by the user against the button.

7. The switch according to claim 5, wherein also in said first position the covering element can be moved by the user in the direction towards said at least one button, going through said through hole of the covering element without interacting with it.

8. The switch according to claim 1, wherein in said first position the covering element cannot be moved by the user in the direction towards said at least one button.

9. The switch according to claim 1, wherein said housing in turn comprises:

a base able to be constrained to external structures in a permanent or removable manner;

a closing cap, coupled at the top with said base and at least partially inserted in said covering element; and a gasket;

wherein said electric actuation means are housed between said base and said gasket and wherein said gasket is at least partially compressed between said closing cap and said base in order to avoid water or humidity from infiltrating towards said electric actuation means.

10. The switch according to claim 9, wherein said closing cap comprises a number of through holes corresponding to the number of buttons of said electric actuation means, the through holes of the closing cap always being aligned with the corresponding buttons, and wherein said gasket completely covers said electric actuation means and the relative buttons and protects them against the entry of water through the through holes of the closing cap.

11. The switch according to claim 10, wherein said gasket is made from a resilient material and extends at least partially through said through holes of the closing cap, towards said covering element, and elastically counteracts the movements of said covering element towards said housing.

12. The Switch according to claim 9, wherein said base is perforated at the bottom for the connection of electric cables outside of said electric actuation means.

13. The switch according to claim 9, also comprising an electric power supply device inside said housing, and remote transmission means of the electrical signals given by the user through said buttons, wherein said remote transmission means and said electric actuation means are supplied with power by said power supply device.

14. The switch according to claim 1, wherein said covering element is shaped to allow, at least in the relative second position, at least one button to be activated by the user by means of a foot, even not covered with a shoe.

15. An electrical switch for nautical uses, comprising:

electric actuation means able to be connected to an external electric circuit, wherein said electric actuation means in turn comprise at least one control button, and a housing for said electric actuation means, characterised in that it also comprises:

a covering element moveable with respect to said housing between a first position, at which said at least one button can be directly activated by the user, and a second position, at which said covering element prevents direct access to the at least one button and can be moved by the user in the direction towards said at least one button for its activation, wherein said covering element is moveable with respect to said housing into a third position, at which the activation of said at least one button by the user is prevented both manually and through said covering element.

16. The switch according to claim 15, wherein said electric actuation means comprise a first button and at least one second button, and wherein:

in said first position of the covering element said buttons can both be directly activated by the user, in said second position of the covering element just one of said buttons can be activated by the user, exclusively by moving the same covering element against the button to be activated, and access to the other button is prevented, and in said third position of the covering element direct access to, and activation of, all of the buttons is prevented regardless of the action of the user on the covering element.

17. The switch according to claim 16, wherein said covering element is provided with a first through hole and at least one second through hole through which at least one of the user's fingers can be inserted and wherein in said first position of the covering element said first through hole and said at least one second through hole are both respectively aligned with the first button and the second button, each of which can be pressed by the user through the corresponding hole of the covering element, and wherein in said second position of the covering element just one among the first through hole and the at least one second through hole is aligned with the relative button and the other among said first button and the at least one second button is offset with respect to said through holes, remaining inaccessible for the user's hands, and is aligned with a surface of said covering element suitable for abutting against a button.

18. The switch according to claim 17, wherein the covering element activates just the button aligned with said abutment surface when it is in said second position and is pushed by the user against the button itself, and does not activate the other button that, in the movement towards the covering element, goes through said through hole without interacting with it.

* * * * *